US011076730B2

(12) United States Patent
Lee et al.

(10) Patent No.: US 11,076,730 B2
(45) Date of Patent: Aug. 3, 2021

(54) ROBOT CLEANER

(71) Applicant: Samsung Electronics Co., Ltd., Suwon-si (KR)

(72) Inventors: Young Seok Lee, Seoul (KR); Simon Ireland, Seongnam-si (KR); Alejandro Vallejo, Suwon-si (KR); Jorn Vicari, Suwon-si (KR); Kyung Jin You, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 296 days.

(21) Appl. No.: 16/208,031

(22) Filed: Dec. 3, 2018

(65) Prior Publication Data

US 2019/0167052 A1 Jun. 6, 2019

(30) Foreign Application Priority Data

Dec. 4, 2017 (KR) ..... 10-2017-0165281

(51) Int. Cl.

| | |
|---|---|
| ***A47L 7/04*** | (2006.01) |
| ***A47L 5/22*** | (2006.01) |
| ***A47L 9/00*** | (2006.01) |
| ***A47L 5/14*** | (2006.01) |
| ***A47L 9/04*** | (2006.01) |
| ***A47L 9/02*** | (2006.01) |

(52) U.S. Cl.

CPC *A47L 7/04* (2013.01); *A47L 5/14* (2013.01); *A47L 5/22* (2013.01); *A47L 9/00* (2013.01); *A47L 9/0027* (2013.01); *A47L 9/02* (2013.01); *A47L 9/0466* (2013.01); *A47L 2201/00* (2013.01)

(58) Field of Classification Search

CPC . A47L 7/04; A47L 9/0027; A47L 5/14; A47L 9/02; A47L 9/00; A47L 5/22; A47L 9/0466; A47L 2201/00

See application file for complete search history.

(56) References Cited

U.S. PATENT DOCUMENTS 8,635,738 B2 * 1/2014 Zita ..... A47L 9/0027 15/310
2001/0002499 A1 * 6/2001 Lindquist ..... A47L 13/40 15/310

(Continued)

FOREIGN PATENT DOCUMENTS

CN 1668238 A 9/2005
CN 101801252 A 8/2010

(Continued)

OTHER PUBLICATIONS

International Search Report dated Mar. 25, 2019, issued in International Patent Application No. PCT/KR2018/015021.

(Continued)

*Primary Examiner* — David Redding
(74) *Attorney, Agent, or Firm* — Jefferson IP Law, LLP

(57) ABSTRACT

A robot cleaner having a side suction port formed on a side surface of a main body so as to suck the dust beside the main body and a side discharge port formed on the side surface of the main body to discharge the air toward the side of the main body is provided. The side discharge port can scatter the dust beside the main body and allow the dust to be sucked smoothly through the side suction port.

20 Claims, 15 Drawing Sheets

(56) References Cited

U.S. PATENT DOCUMENTS

| | | | | |
|---|---|---|---|---|
| 2002/0174506 | A1 | 11/2002 | Wallach et al. | |
| 2005/0015914 | A1* | 1/2005 | You | F24F 3/1603 15/319 |
| 2005/0022331 | A1 | 2/2005 | Kim et al. | |
| 2005/0022485 | A1 | 2/2005 | Park et al. | |
| 2005/0279059 | A1 | 12/2005 | Lee et al. | |
| 2007/0113373 | A1 | 5/2007 | Hato et al. | |
| 2008/0206092 | A1 | 8/2008 | Crapser et al. | |
| 2009/0271940 | A1 | 11/2009 | Lee | |
| 2017/0035262 | A1 | 2/2017 | Li et al. | |
| 2017/0231448 | A1 | 8/2017 | Hong et al. | |
| 2019/0125154 | A1* | 5/2019 | Fay | A47L 9/0477 |
| 2019/0202301 | A1* | 7/2019 | O'Brien | B60L 53/14 |

FOREIGN PATENT DOCUMENTS

| | | | |
|---|---|---|---|
| CN | 102525335 | A | 7/2012 |
| CN | 102665514 | A | 9/2012 |
| CN | 202761189 | U | 3/2013 |
| CN | 106793898 | A | 5/2017 |
| DE | 44 25 924 | A1 | 1/1996 |
| DE | 20 2006 013372 | U1 | 3/2007 |
| EP | 1 992 266 | A2 | 11/2008 |
| EP | 2 692 271 | A1 | 2/2014 |
| EP | 3 127 462 | A1 | 2/2017 |
| JP | 5160678 | B1 | 12/2012 |
| JP | 2016-168467 | A | 9/2016 |
| KR | 10-0137488 | B1 | 5/1998 |
| KR | 10-2005-0013919 | * | 2/2005 |
| KR | 10-2006-0067780 | A | 6/2006 |
| KR | 10-2007-0007011 | * | 1/2007 |
| KR | 10-2011-0052032 | A | 5/2011 |
| KR | 10-2015-0143209 | A | 12/2015 |
| WO | 2014/021620 | A1 | 2/2014 |
| WO | 2016/027745 | A1 | 2/2016 |

OTHER PUBLICATIONS

Extended European Search Report dated Nov. 27, 2020, issued in European Application No. 18887173.5.

Chinese Office Action dated Apr. 28, 2021, issued in Chinese Patent Application No. 201880078119.7.

* cited by examiner

ROBOT CLEANER

CROSS-REFERENCE TO RELATED APPLICATION(S)

This application is based on and claims priority under 35 U.S.C. § 119(a) of a Korean patent application number 10-2017-0165281, filed on Dec. 4, 2017, in the Korean Intellectual Property Office, the disclosure of which is incorporated by reference herein in its entirely.

BACKGROUND

1. Field

The disclosure relates to a robot cleaner capable of efficiently cleaning not only a lower side of the robot cleaner but also a lateral side and an upper side of the robot cleaner.

2. Description of the Related Art

A robot cleaner is a home appliance that self-runs without user's operation and cleans any area. The robot cleaner includes a driving unit including wheels, a sensor for sensing the surrounding environment, a fan for generating a suction force, and a dust collecting apparatus for removing dust from the air sucked into a main body. The robot cleaner travels along a floor surface and it sucks air on the floor surface to perform cleaning.

Generally, a suction port of the robot cleaner is formed on the bottom surface of the main body, and the suction port is provided with a rotating brush. The brush rotates to scatter dust, trash and the like accumulated on a floor surface while rotating the brush. The scattered dust, trash and the like are sucked into the main body by the suction force of the fan.

However, such robot cleaner can only perform cleaning on the floor surface, thus limiting the cleaning range. In other words, it is difficult to clean areas adjacent to side walls of a facility such as a compartment, a corner area, an area located higher than the floor surface such as a washboard, and the like. In addition, it is difficult to clean dirt, human hair, and pet hair attached to the side walls of compartments or furniture, or floating in the air.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a robot cleaner capable of enlarging a cleaning area to side walls or corners of a facility.

Another aspect of the disclosure is to provide a robot cleaner having a simple structure with improved cleaning efficiency at the time of cleaning a side wall or a corner of a facility.

Another aspect of the disclosure is to provide a robot cleaner provided with a cleaning tool capable of manual operation to clean pet hair or the like or efficiently clean furniture and the like.

Additional aspects will be set forth in part in the description which follows and, in part, will be apparent from the description, or may be learned by practice of the presented embodiments.

In accordance with an aspect of the disclosure, a robot cleaner is provided. The robot cleaner includes a main body, a fan provided inside the main body and configured to generate a suction force, a dust collecting apparatus provided to remove dust from the air sucked into the main body, a side suction port formed on a side surface of the main body to suck dust beside the main body into the main body, and a side discharge port formed on the side surface of the main body to discharge air toward the side of the main body and scatter dust beside the main body to be sucked through the side suction port.

The side surface of the main body may include a left surface and a right surface, the side suction port may be formed on at least one of the left surface or the right surface, and the side discharge port may be formed on the side surface on which the side suction port is formed.

The side suction port and the side discharge port are arranged to face each other.

The robot cleaner may further include a bottom suction port formed on a bottom surface of the main body to suck dust below the main body, a main suction passage to guide the air sucked through the bottom suction port to the dust collecting apparatus, and an auxiliary suction passage to guide the air sucked through the side suction port to the dust collecting apparatus.

The main suction passage and the auxiliary suction passage may join together in front of the dust collecting apparatus.

The robot cleaner may further include a switching valve provided at a point where the main suction passage and the auxiliary suction passage join together such that the suction force of the fan is transmitted to either the main suction passage or the auxiliary suction passage.

The switching valve may include a cylindrical valve housing and a valve body rotatably provided in the cylindrical valve housing.

The valve body may be configured to be rotatable between a first position to open the main suction passage and close the auxiliary suction passage, and a second position to close the main suction passage and open the auxiliary suction passage.

The valve body may include a valve passage connected to one of the main suction passage and the auxiliary suction passage, and the valve passage may be connected to the main suction passage when the valve body is in the first position and the valve passage is connected to the auxiliary suction passage when the valve body is in the second position.

The dust collecting apparatus may include an inlet through which the air sucked through the main suction passage or the auxiliary suction passage flows, a cyclone chamber to centrifugally separate the dust by turning the air introduced through the inlet, a dust collecting chamber to collect the dust that has been removed from the cyclone chamber, and an outlet to discharge the dust-removed air from the cyclone chamber.

The robot cleaner may further include an electrostatic adsorption plate provided on the side surface of the main body to adsorb dust from the outside of the main body through static electricity.

The electrostatic adsorption plate may be disposed between the side suction port and the side discharge port.

In accordance with another aspect of the disclosure, a robot cleaner includes a main body, a fan provided inside the main body and configured to generate a suction force, a dust collecting apparatus provided to remove dust from the air sucked into the main body, and an electrostatic adsorption plate provided on at least one of a top surface or a side surface of the main body to adsorb dust outside the main body through static electricity.

The electrostatic adsorption plate may be provided on the side surface of the main body, and the robot cleaner may further include a side suction port formed on the side surface of the main body to suck dust adhering to the electrostatic adsorption plate.

The electrostatic adsorption plate may be provided on the top surface of the main body, and the robot cleaner may further include a top suction port formed on the top surface of the main body to suck dust adhering to the electrostatic adsorption plate.

In accordance with another aspect of the disclosure, a robot cleaner is provided. The robot cleaner includes a main body, a fan provided inside the main body and configured to generate a suction force, a dust collecting apparatus provided to remove dust from the air sucked into the main body, a suction port formed on a bottom surface of the main body to suck dust below the main body, a main suction passage to guide the air sucked through the suction port to the dust collecting apparatus, a cleaning tool for hand-held and manual cleaning, a tool mounting part provided on the main body to detachably mount the cleaning tool, and an auxiliary suction passage to suck dust from the tool mounting part to remove dust attached to the cleaning tool mounted on the tool mounting part and guide the dust to the dust collecting apparatus.

The tool mounting part may include a scraper configured to scrape dust adhering to the cleaning tool when the cleaning tool is mounted on the tool mounting part.

The scraper may be configured to move in a process of mounting the cleaning tool, and the tool mounting part may include an elastic member to elastically support the scraper.

The main suction passage and the auxiliary suction passage may join together in front of the dust collecting apparatus.

The robot cleaner may further include a switching valve provided at a position where the main suction passage and the auxiliary suction passage join together such that the suction force of the fan is transmitted to either the main suction passage or the auxiliary suction passage.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understood but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
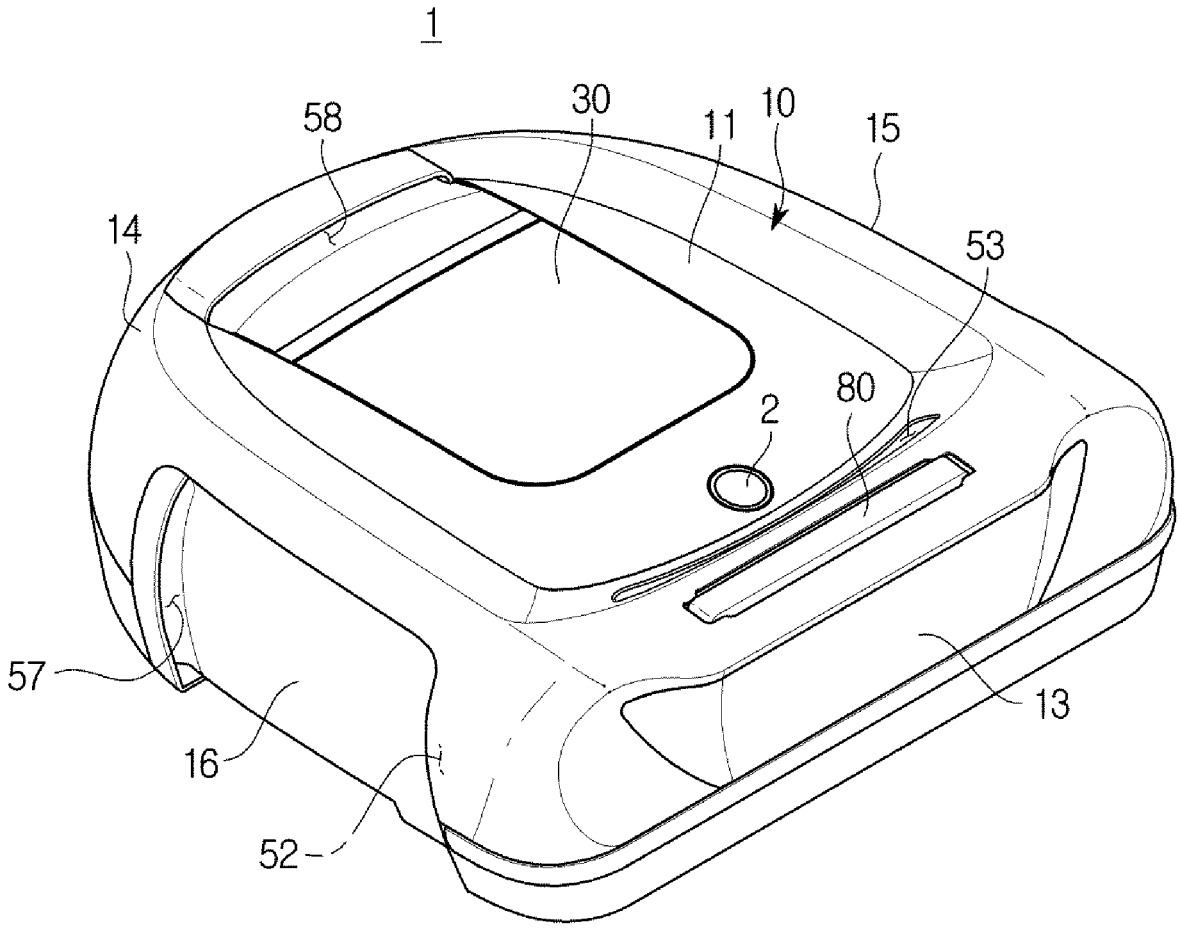
FIG. 1 is a perspective view showing a robot cleaner according to an embodiment of the disclosure.
Figure 2:
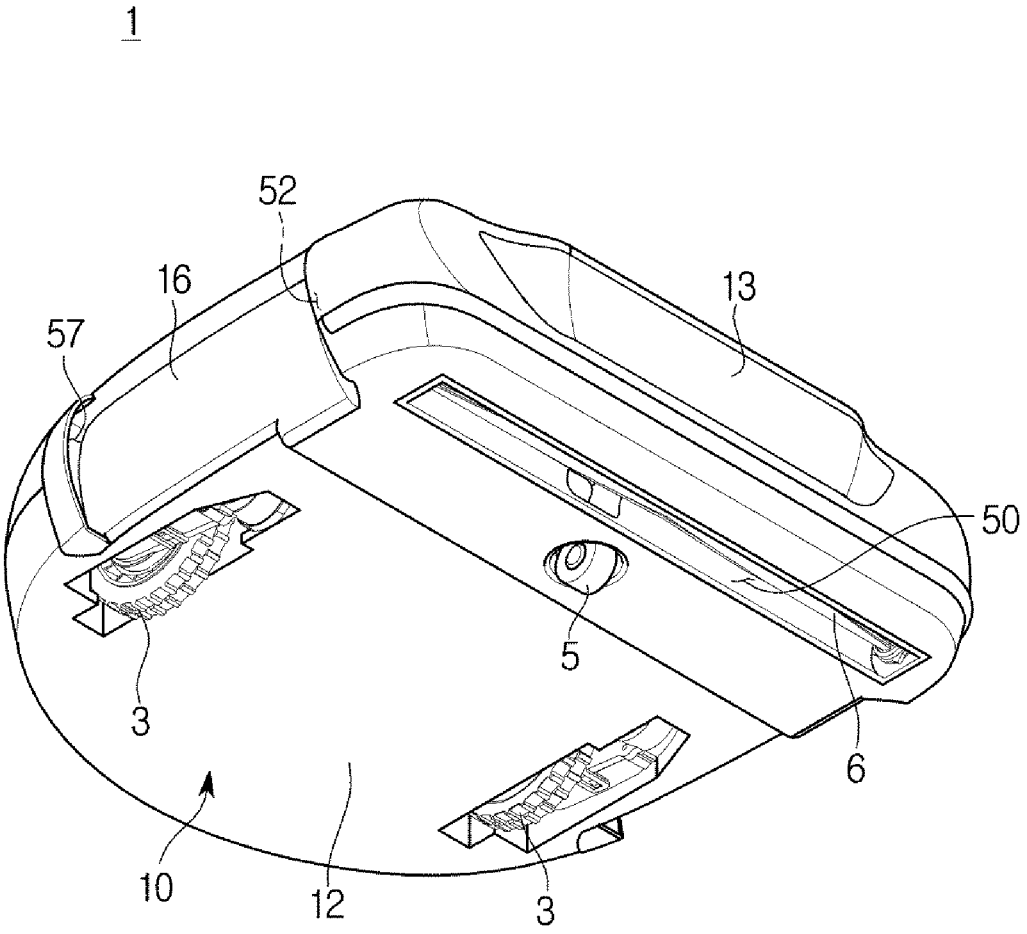
FIG. 2 is a bottom perspective view of the robot cleaner of FIG. 1 according to an embodiment of the disclosure.
Figure 3:
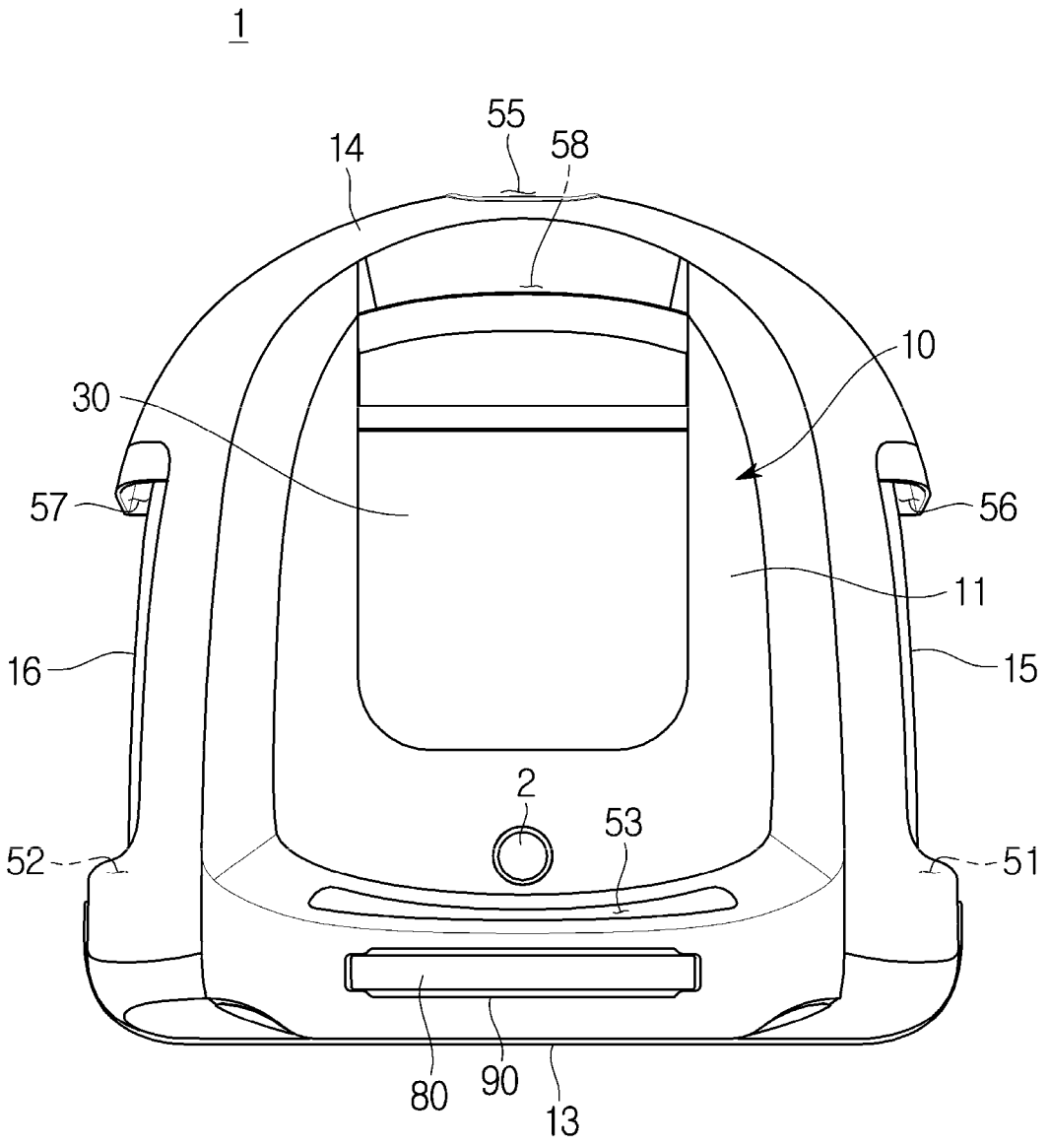
FIG. 3 is a plan view of the robot cleaner of FIG. 1 according to an embodiment of the disclosure.
Figure 4:
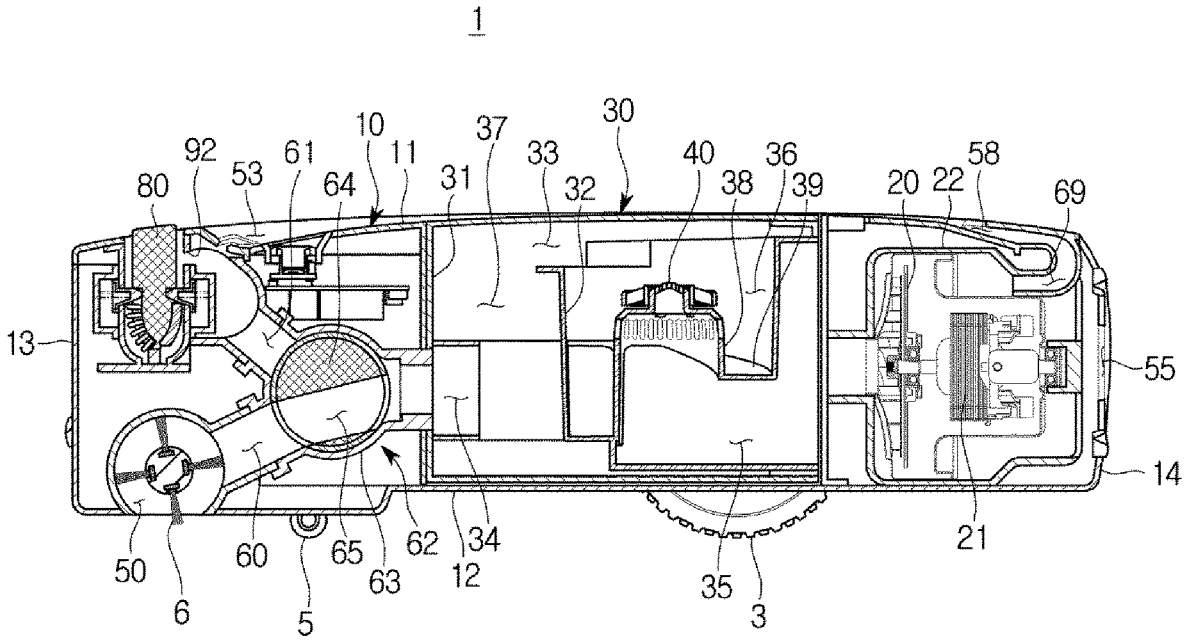
FIG. 4 is a side cross sectional view of the robot cleaner of FIG. 1 according to an embodiment of the disclosure.
Figure 5:
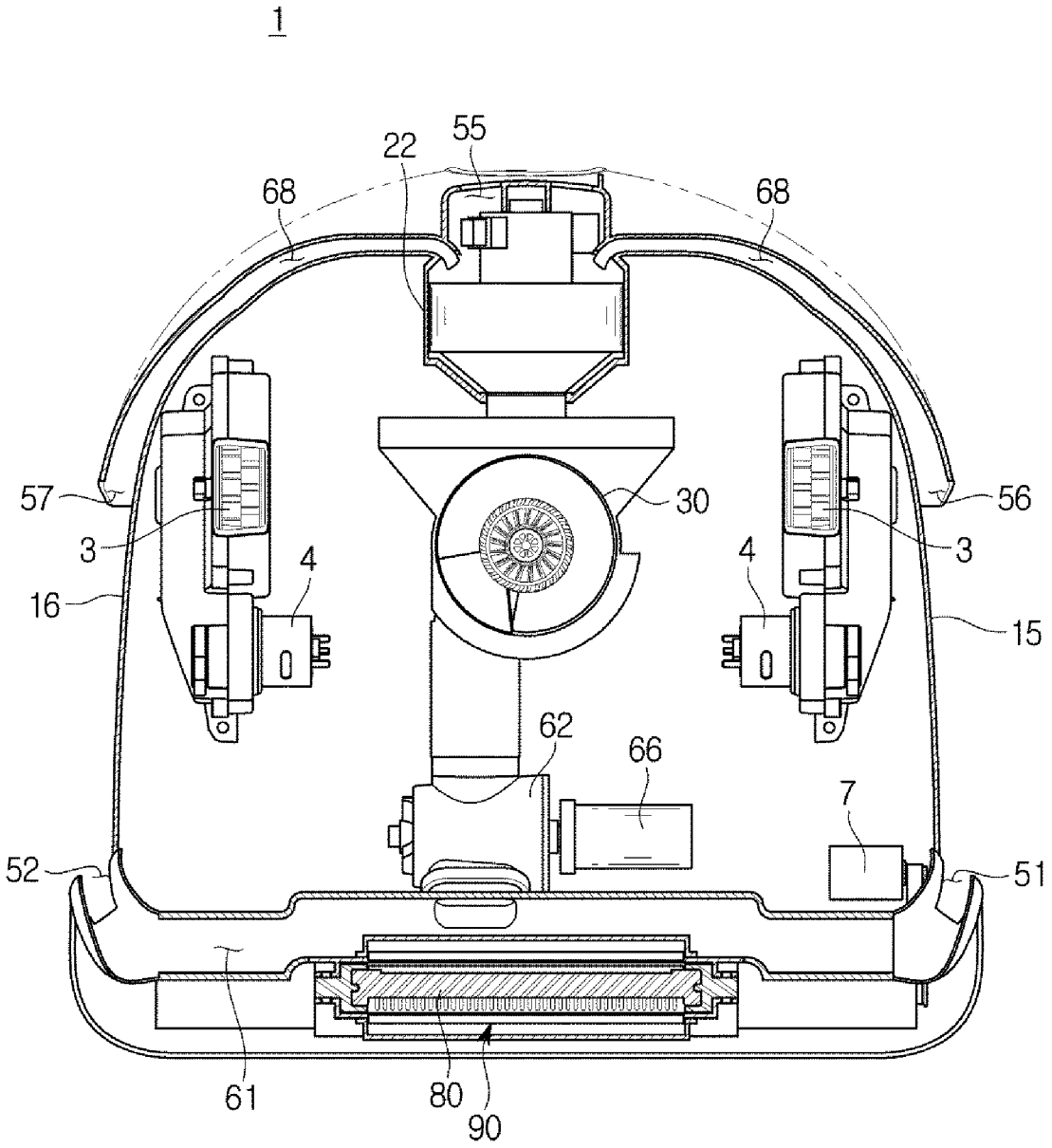
FIG. 5 is a plan sectional view of the robot cleaner of FIG. 1 according to an embodiment of the disclosure.
Figure 6:
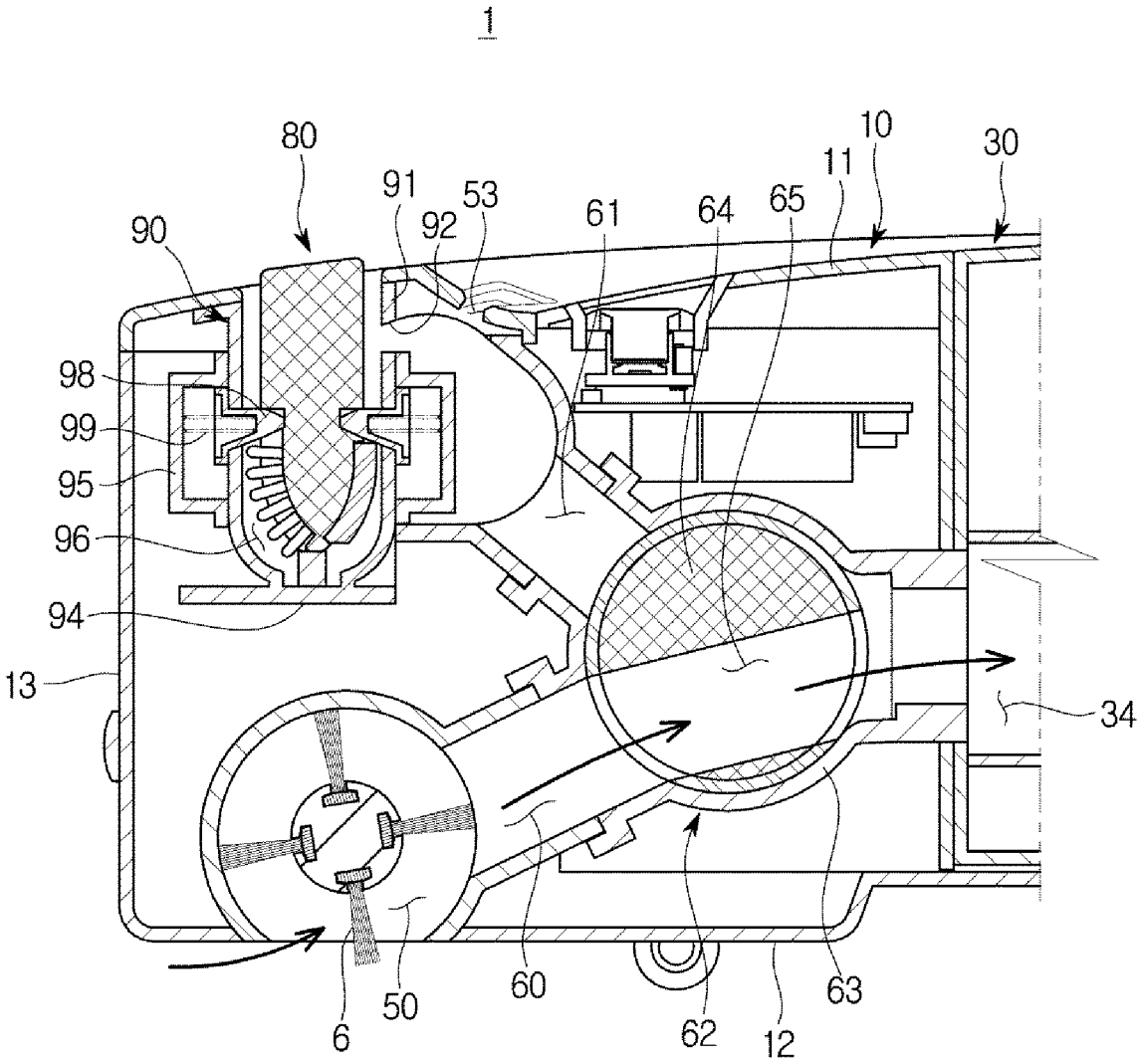
FIG. 6 is a view showing a state in which a valve body of the robot cleaner of FIG. 1 is in a first position according to an embodiment of the disclosure.
Figure 7:
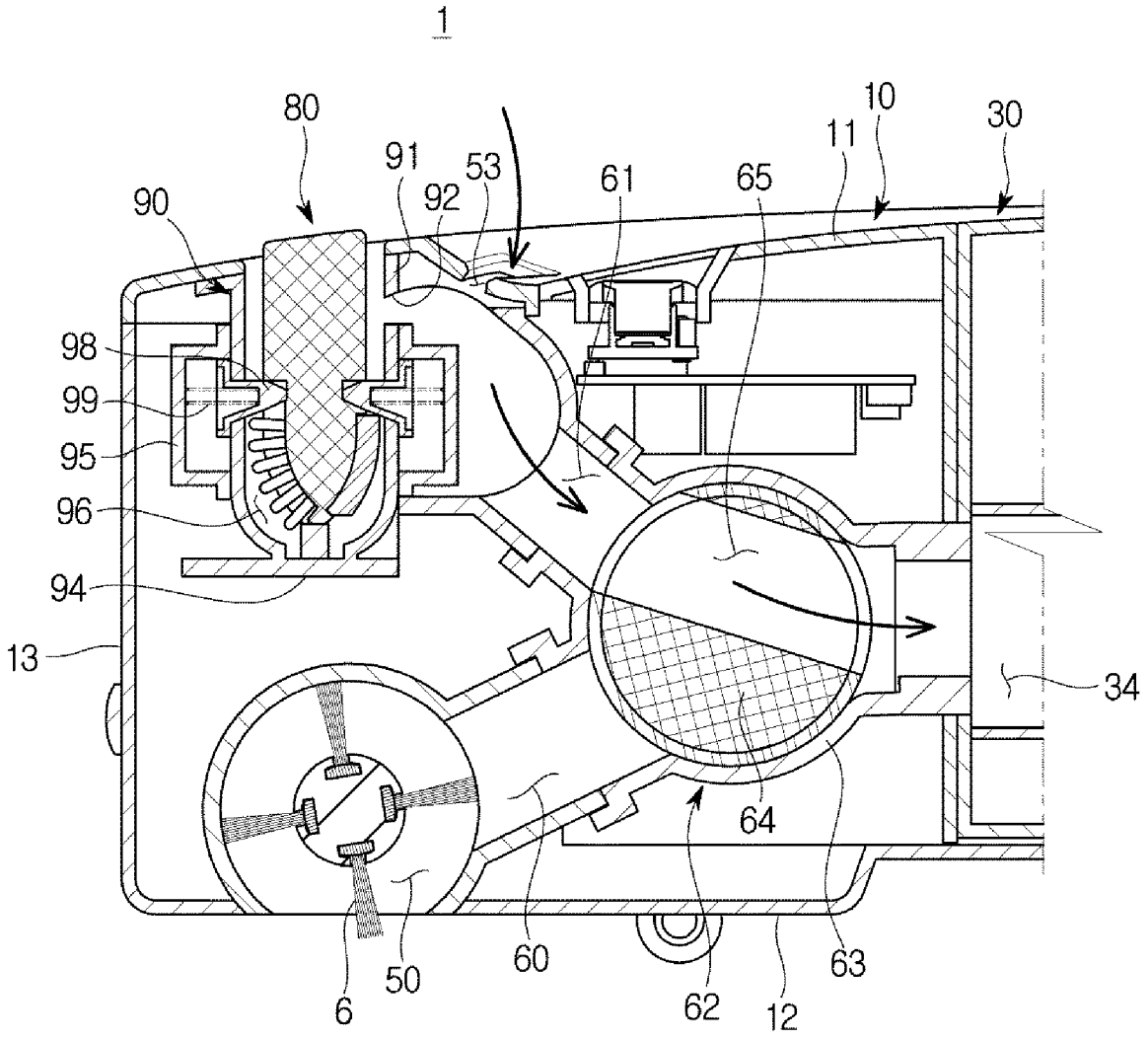
FIG. 7 is a view showing a state in which the valve body of the robot cleaner of FIG. 1 is in a second position according to an embodiment of the disclosure.

FIG. 1 is a perspective view showing a robot cleaner according to an embodiment of the disclosure. FIG. 2 is a bottom perspective view of the robot cleaner of FIG. 1 according to an embodiment of the disclosure. FIG. 3 is a plan view of the robot cleaner of FIG. 1 according to an embodiment of the disclosure. FIG. 4 is a side cross sectional view of the robot cleaner of FIG. 1 according to an embodiment of the disclosure. FIG. 5 is a plan sectional view of the robot cleaner of FIG. 1 according to an embodiment of the disclosure. FIG. 6 is a view showing a state in which a valve body of the robot cleaner of FIG. 1 is in a first position according to an embodiment of the disclosure. FIG. 7 is a view showing a state in which the valve body of the robot cleaner of FIG. 1 is in a second position according to an embodiment of the disclosure.

Referring to FIGS. 1 to 7, a robot cleaner 1 includes a main body 10, a fan 20 provided inside the main body 10 to generate a suction force, and a dust collecting apparatus 30 provided to remove foreign matter such as dust from the air sucked into the main body 10.

The main body 10 forms an outer appearance of the robot cleaner 1 and includes a top surface 11, a bottom surface 12, a front surface 13, a rear surface 14, a left surface 15, and a right surface 16. The front surface 13, the rear surface 14, the left surface 15 and the right surface 16 connect the top surface ill and the bottom surface 12. The front surface 13, the rear surface 14, the left surface 15, and the right surface 16 may be formed as planes or curved surfaces, respectively.

That is, in the embodiment, the front surface 13 is substantially linear when viewed from above the robot cleaner 1, and the rear surface 14, the left surface 15, and the right surface 16 are formed in a substantially curved shape. However, it is not limited thereto. That is, the front surface 13, the rear surface 14, the left surface 15, and the right surface 16 are all formed in an arc shape, and the robot cleaner 1 may be formed to have a circular shape as a whole when viewed from above.

A sensor unit 2 may be provided on the top surface 11 of the main body 10 to sense the surrounding environment for autonomously running the robot cleaner 1 or to receive signals from a remote controller (not shown).

A wheel 3 to run the robot cleaner 1 and a caster 5 to assist the wheels 3 and allow the main body 10 to travel stably can be provided on the bottom surface 12 of the main body 10. A pair of the wheels 3 is provided on the rear portion of the bottom surface 12 of the main body, and the caster 5 may be provided in front of the wheel 3. A wheel drive unit 4 for driving the wheel 3 may be provided inside the main body 10. The wheel drive unit 4 may include a drive motor for generating a rotational force, a gear assembly for transmitting the rotational force of the motor to the wheel 3, and the like.

A bottom suction port 50 is formed in the bottom surface 12 of the main body 10 so as to suck the dust of an indoor or outdoor floor G into the main body 10, and the bottom suction port 50 may be provided with a brush 6 to scatter dust adhering to the floor G so as to be sucked smoothly. The brush 6 is rotatably provided and the main body 10 may be provided with a brush drive motor 7 to drive the brush 6.

The dust collecting apparatus 30 may be provided at the center of the main body 10. The dust collecting apparatus 30 can be mounted on the main body 10 so as to be detachable upward. In an embodiment, the dust collecting apparatus 30 is a cyclone type in which dust is separated using a centrifugal force. However, the disclosure is not limited thereto, and the dust collecting apparatus 30 using a dust bag or a filter may be employed.

As shown in FIG. 4, the dust collecting apparatus 30 includes an outer wall 31, a cyclone chamber 36 to form a swirling airflow to separate dust by the centrifugal force, a dust collecting chamber 37 to collect the dust separated through the cyclone chamber 36, an inner wall 32 to partition the cyclone chamber 36 and the dust collecting chamber 37, an opening 33 formed in the inner wall 32 so that the dust of the cyclone chamber 36 moves to the dust collecting chamber 37, an inlet 34 through which the air outside the dust collecting apparatus 30 flows into the dust collecting apparatus 30, and an outlet 35 through which air with the dust removed through the cyclone chamber 36 flows out of the dust collecting apparatus 30.

A guide wall 38 is formed inside of the cyclone chamber 36 so as to guide the swirling airflow. A spiral wall 39 formed to be inclined in a helical shape may be provided around the guide wall 38 so as to form a swirl flow. The inner space of the guide wall 38 communicates with the outlet 35 and the upper portion of the guide wall 38 is provided with a grill 40 formed to prevent foreign matter such as dust from flowing to the outlet 35 and to guide air to flow to the outlet 35.

With this configuration, the air outside the dust collecting apparatus 30 flows into the cyclone chamber 36 through the inlet 34 and is circulated around the guide wall 38 along the spiral wall 39 in the cyclone chamber 36. In the course of turning, the dust is separated from the air by the centrifugal force, and the separated dust is collected through the opening 33 into the dust collecting chamber 37. The dust-removed air may pass through the grill 40 over the guide wall 38 and be discharged to the outside of the dust collecting apparatus 30 through the outlet 35. When cleaning is completed, the user can remove the dust collecting apparatus 30 from the main body 10, remove the dust collected in the dust collecting chamber 37, and mount the dust collecting apparatus 30 in the main body 10 again.

The fan 20 is connected to a motor 21 and can generate a suction force. The fan 20 and the motor 21 may be disposed in a fan motor chamber 22 at the rear of the main body 10. The fan motor chamber 22 can be connected to the outlet 35 of the dust collecting apparatus 30.

The robot cleaner 1 may include side suction ports 51 and 52 formed in the side surfaces 15 and 16 of the main body 10 so as to suck dust beside the main body 10 into the main body 10. The side suction ports 51 and 52 may be formed on both the left surface 15 and the right surface 16 of the main body. But the disclosure is not limited thereto and the side suction ports 51 and 52 may be formed on only one of the left surface 15 and the right surface 16 of the main body.

The robot cleaner 1 may include a top suction port 53 formed on the top surface 11 of the main body 10 so as to suck dust above the main body 10 into the main body 10.

That is, the robot cleaner 1 includes the bottom suction port 50 formed on the bottom surface 12 of the main body, the side suction ports 51 and 52 formed on the side surfaces 15 and 16 of the main body, and the top suction port 53 formed on the top surface 11 of the main body.

The robot cleaner 1 includes a main suction passage 60 to transmit the suction force of the fan 20 to the bottom suction port 50 to suck air through the bottom suction port 50, and an auxiliary suction passage 61 to transmit the suction force of the fan 20 to the side suction ports 51 and 52 and the top suction port 53 to suck air through the side suction ports 51 and 52 and the top suction port 53.

That is, the main suction passage 60 connects the bottom suction port 50 to the inlet 34 of the dust collecting apparatus, and the auxiliary suction passage 61 can connect the side suction ports 51 and 52 and the inlet 34 of the dust collecting apparatus.

The main suction passage 60 and the auxiliary suction passage 61 may be arranged to join together in front of the dust collecting apparatus 30. That is, the main suction passage 60 and the auxiliary suction passage 61 can be joined to the inlet 34 of the dust collecting apparatus 30 by one passage.

A switching valve 62 may be provided to select whether to transmit the suction force of the fan 20 to the main suction passage 60 or to the auxiliary suction passage 61 at a point where the main suction passage 60 and the auxiliary suction passage 61 join. The switching valve 62 includes a cylindrical valve housing 63, a valve body 64 rotatably provided in the cylindrical valve housing 63, and a valve motor 66 to drive the valve body 64.

The valve body 64 may be configured to be rotatable between a first position (FIG. 6) in which the main suction passage 60 is opened and the auxiliary suction passage 61 is closed and a second position (FIG. 7) in which the main suction passage 60 is closed and the auxiliary suction passage 61 is opened. For this purpose, the valve body 64 may include a valve passage 65 formed therein to be connected to either the main suction passage 60 or the auxiliary suction passage 61, depending on the position of the valve body 64.

The valve passage 65 is connected to the main suction passage 60 when the valve body 64 is in the first position and is connected to the auxiliary suction passage 61 when the valve body 64 is in the second position.

With this configuration, the robot cleaner 1 can have a first cleaning mode in which the valve body 64 is in the first position and a second cleaning mode in which the valve body 64 is in the second position. In the first cleaning mode, the main suction passage 60 is opened and the auxiliary suction passage 61 is closed so that the air on the floor can be cleaned through the bottom suction port 50. In the second cleaning mode, the main suction passage 60 is closed and the auxiliary suction passage 61 is opened so that the air in the lateral side and upper side of the main body can be sucked and cleaned through the side suction ports 51 and 52 and the top suction port 53.

As described above, the robot cleaner 1 of the disclosure has a structure in which the main suction passage 60 and the auxiliary suction passage 61 can receive the suction force from the fan 20. Thus, there is no need to add a fan and a motor and a cost increase and space reduction can both be avoided.

The main suction passage 60 and the auxiliary suction passage 61 are joined to each other to select one of the main suction passage 60 and the auxiliary suction passage 61 through the switching valve 62. Therefore, since the suction force of the fan 20 is not dispersed in the plurality of passages, the suction force may not decrease.

The robot cleaner 1 includes side discharge ports 56 and 57 formed on the side surfaces 15 and 16 of the main body 10 and top discharge port 58 formed on the top surface 11 of the main body 10 in addition to a rear discharge port 55.

The exhaust air discharged through the side discharge ports 56 and 57 can scatter the dust on the side of the main body 10 so that the dust on the side of the main body 10 can be sucked smoothly through the side suction ports 51 and 52. The side discharge ports 56 and 57 according to the embodiment of the disclosure can increase the suction efficiency through the side suction ports 51 and 52 by scattering the dust on the sides by guiding the air stream laterally rather than rearward.

The side discharge ports 56 and 57 may be formed in at least one of the left surface 15 or the right surface 16 of the main body 10 in which the side suction ports 51 and 52 are formed.

The side suction ports 51 and 52 may be formed so that the direction of the suction air sucked through the side suction ports 51 and 52 is not perpendicular to the side surfaces 15 and 16 of the main body. In other words, the direction of the suction air sucked through the side suction ports 51 and 52 can be aligned or oblique to the side surfaces 15 and 16 of the main body. For this purpose, the side suction ports 51 and 52 can be opened toward the rear of the main body 10 rather than toward the side of the main body 10.

The side discharge ports 56 and 57 may also be formed such that the direction of the exhaust wind discharged through the side discharge ports 56 and 57 is not perpendicular to the side surfaces 15 and 16 of the main body. That is, the direction of the exhaust wind that is discharged through the side discharge ports 56 and 57 can be parallel or oblique to the side surfaces 15 and 16 of the main body. For this purpose, the side discharge ports 56 and 57 can be opened toward the front of the main body 10, rather than toward the side of the main body 10. Therefore, the side suction ports 51 and 52 and the side discharge ports 56 and 57 may be formed so as to substantially face each other.

The robot cleaner 1 includes a side discharge passage 68 to discharge dust-removed air to the side discharge ports 56 and 57 and a top discharge passage 69 to discharge the air to the side discharge passage 68. The side discharge passage 68 connects the fan motor chamber 22 and the side discharge ports 56 and 57 and the top discharge passage 69 connects the fan motor chamber 22 and the top discharge passage 69.

With this structure, the dust on the side of the main body 10 is affected by both the exhaust air discharged from the side discharge ports 56 and 57 and the suction air sucked through the side suction ports 51 and 52, so that the suction efficiency can be increased.

Figure 8:
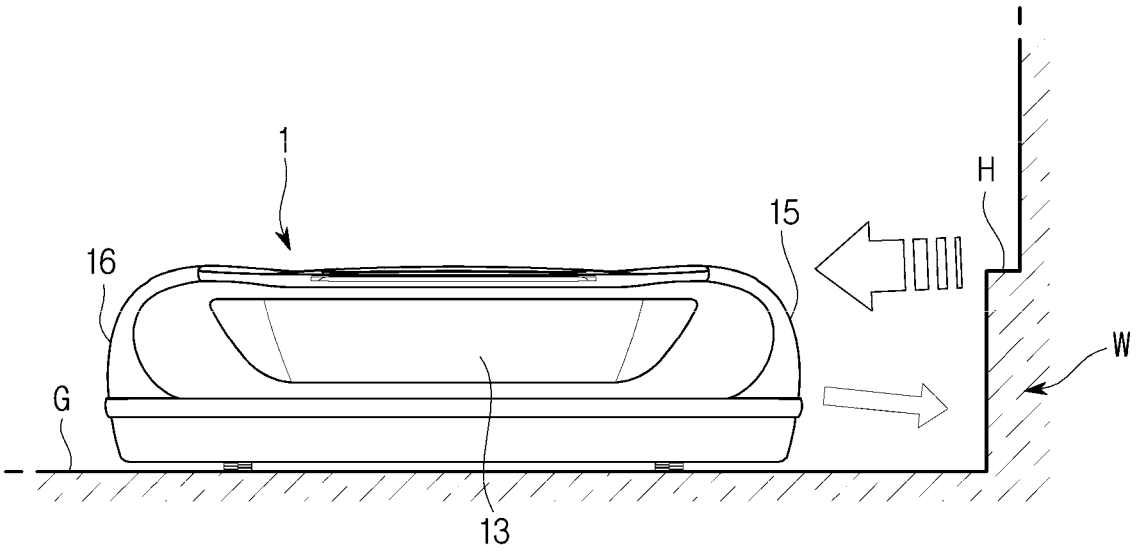
FIG. 8 is a front view showing a cleaning operation of the robot cleaner of FIG. 1 according to an embodiment of the disclosure.
Figure 9:
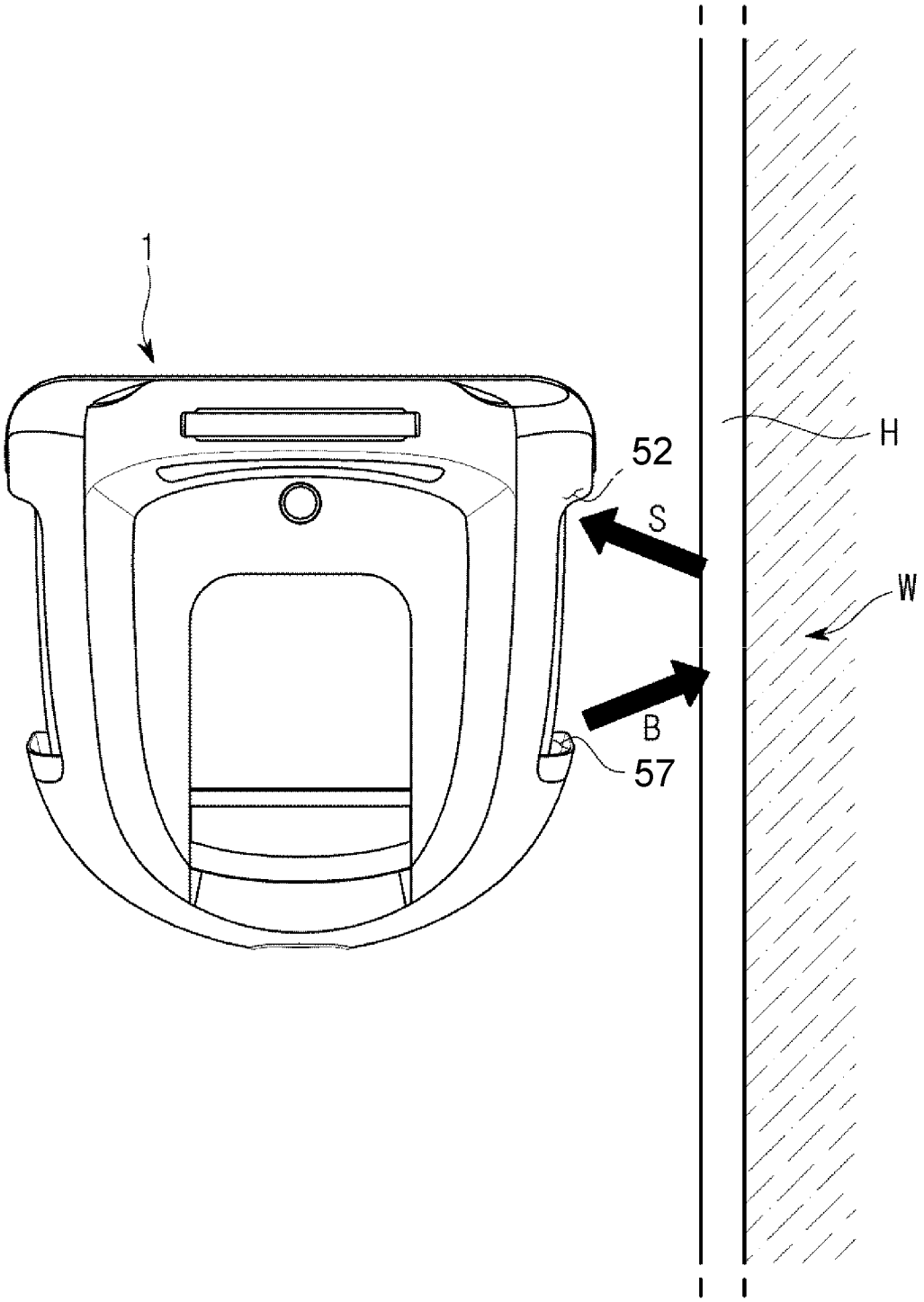
FIG. 9 is a plan view showing the cleaning operation of the robot cleaner of FIG. 1 according to an embodiment of the disclosure.

FIG. 8 is a front view showing a cleaning operation of the robot cleaner of FIG. 1 according to an embodiment of the disclosure. FIG. 9 is a plan view showing the cleaning operation of the robot cleaner of FIG. 1 according to an embodiment of the disclosure.

A cleaning operation of the robot cleaner 1 according to the embodiment of the disclosure will be briefly described with reference to FIGS. 8 and 9.

The robot cleaner 1 may have the first cleaning mode for cleaning the indoor and outdoor floor G and the second cleaning mode for cleaning the side and the top of the robot cleaner 1 according to the position of the valve body 64.

In the second cleaning mode, as shown in FIG. 8, the robot cleaner 1 sucks the air on the side of the robot cleaner 1 through the side suction port 51. Therefore, the robot cleaner 1 can clean dust, garbage, pet hair and the like that is adjacent to a side wall W of the facility such as a compartment or on a surface H higher than the floor G.

As shown in FIG. 9, since the dust on the sides of the robot cleaner can be scattered by the exhaust air discharged through the top discharge port 58 formed on the side surface of the main body 10 when cleaning the sides, the cleaning efficiency can be increased.

Figure 10:
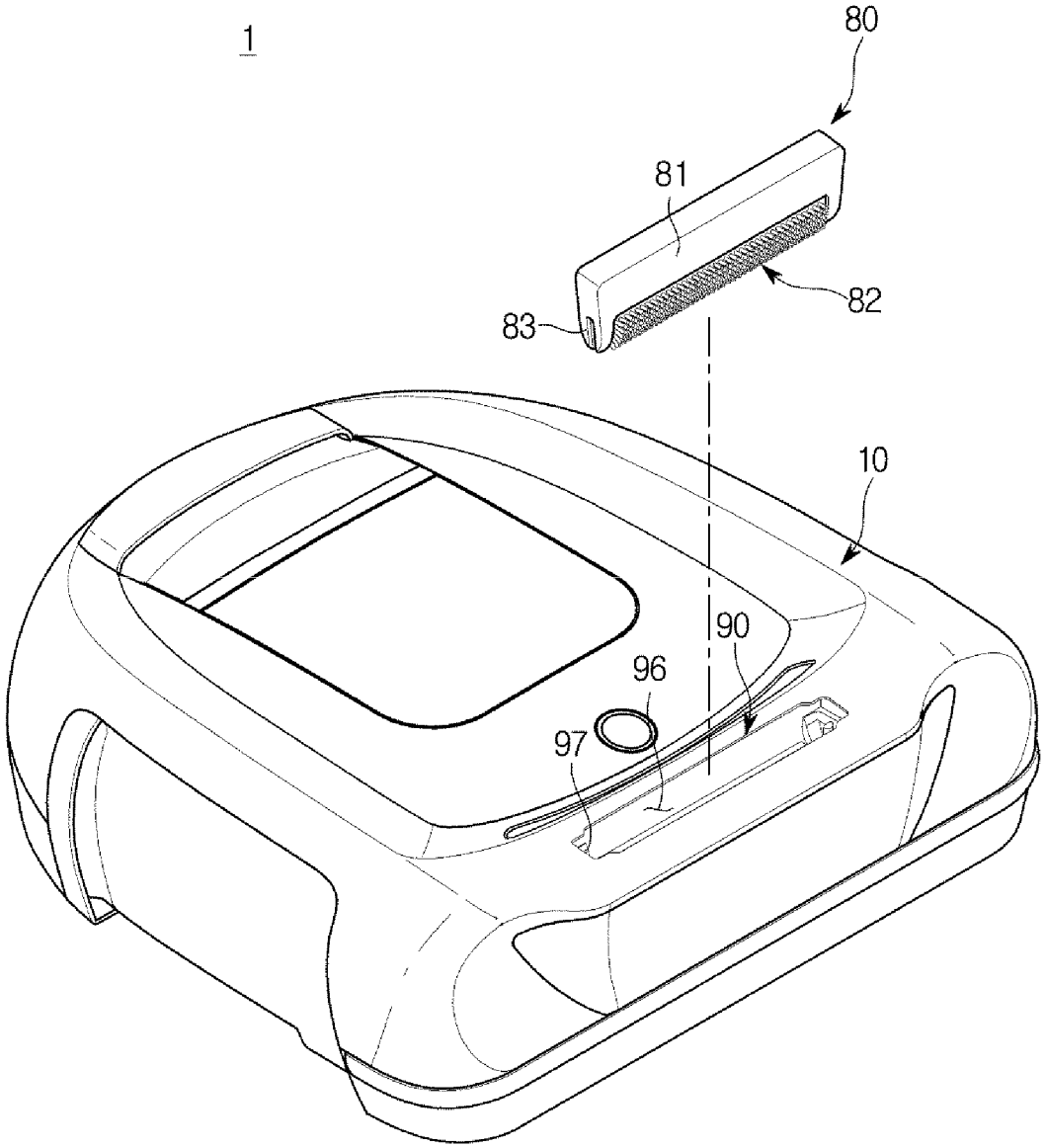
FIG. 10 is a view showing a state in which a cleaning tool of the robot cleaner of FIG. 1 is separated according to an embodiment of the disclosure.
Figure 11:
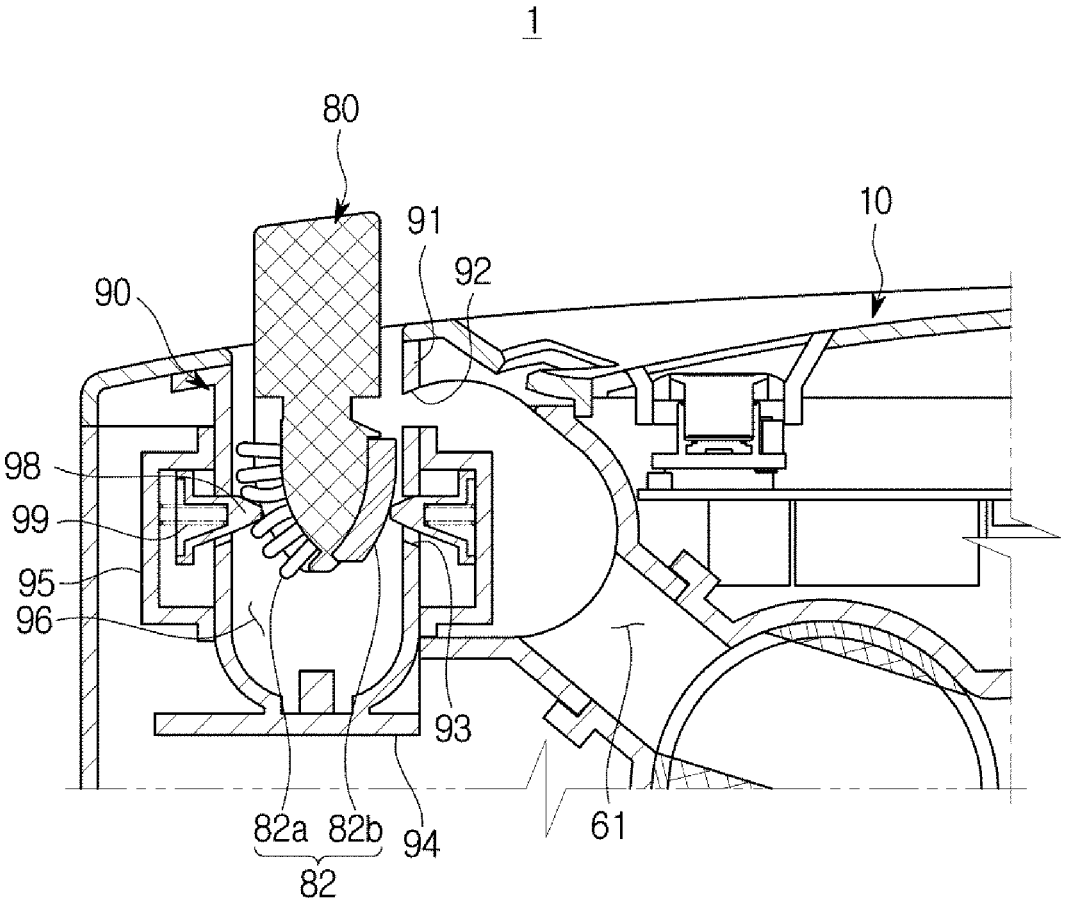
FIG. 11 is a view showing a process of mounting the cleaning tool of the robot cleaner on a tool mounting part according to an embodiment of the disclosure.
Figure 12:
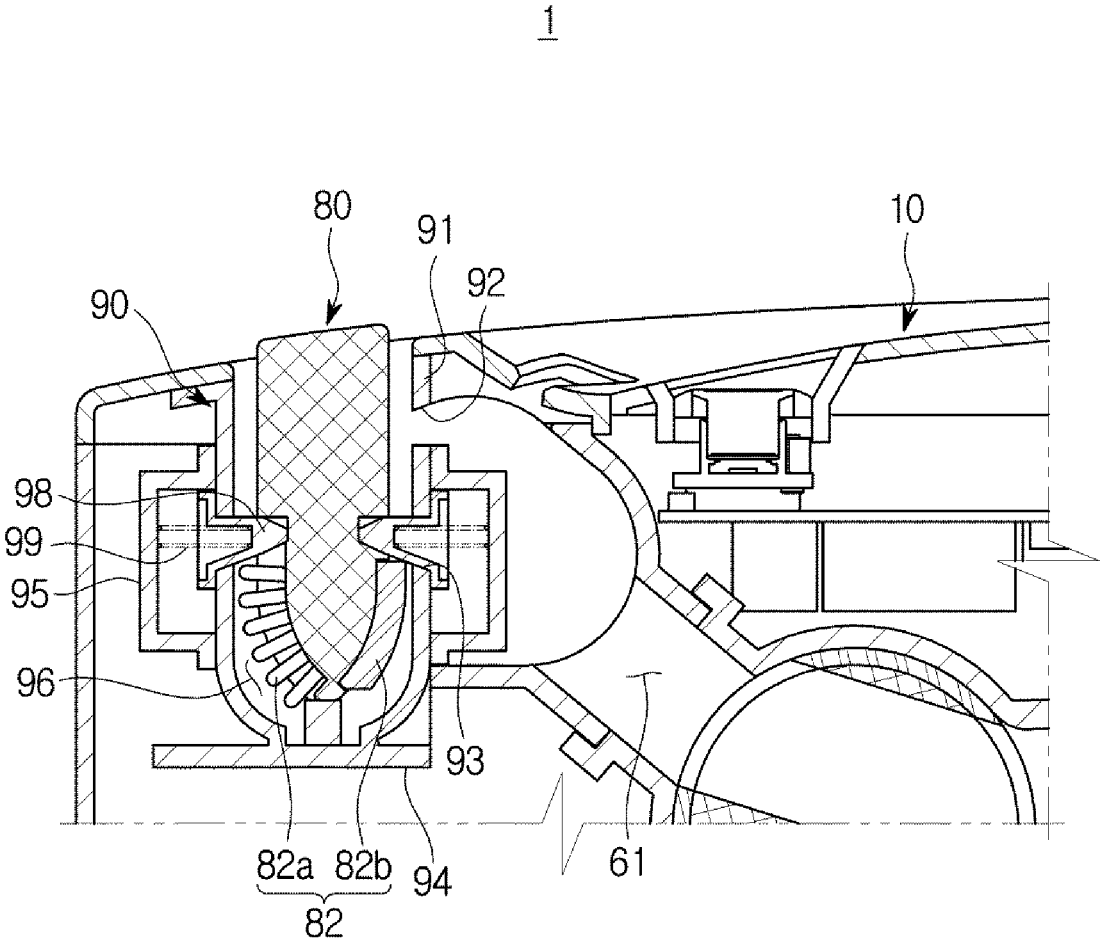
FIG. 12 is a view showing a state in which the cleaning tool of the robot cleaner of FIG. 1 is mounted on the tool mounting part according to an embodiment of the disclosure.

FIG. 10 is a view showing a state in which a cleaning tool of the robot cleaner of FIG. 1 is separated according to an embodiment of the disclosure. FIG. 11 is a view showing a process of mounting the cleaning tool of the robot cleaner on a tool mounting part according to an embodiment of the disclosure. FIG. 12 is a view showing a state in which the cleaning tool of the robot cleaner of FIG. 1 is mounted on the tool mounting part according to an embodiment of the disclosure.

Referring to FIGS. 10 to 12, a cleaning tool 80 of the robot cleaner according to the embodiment of the disclosure will be described.

The robot cleaner 1 may include the cleaning tool 80. The user can manually clean the tool by holding the cleaning tool 80 by hand. The cleaning tool 80 may be detachably mounted to the main body 10. To this end, the main body 10 may be provided with a tool mounting part 90 to which the cleaning tool 80 is detachably mounted. The tool mounting part 90 may be formed on the upper portion of the main body 10.

The cleaning tool 80 may include a handle 81 that can be held by hand and a cleaning member 82 provided under the handle 81. The cleaning member 82 may include a plurality of cleaning members 82*a* and 82*b*. For example, the first cleaning member 82*a* of the brush type that can trim pet hair is provided on one side of the cleaning tool 80, and the second cleaning member 82*b* that can clean cloth or leather is provided on the other side of the cleaning tool 80. The cleaning tool 80 may be provided with a coupling groove 83 and the tool mounting part 90 may include a coupling protrusion 97 to be inserted into the coupling groove 83.

The tool mounting part 90 may include a side wall 91, a bottom wall 94, and a mounting space 96 formed by the side wall 91 and the bottom wall 94. The mounting space 96 is formed so that the upper surface thereof is opened and the cleaning tool 80 can be mounted or dismounted through the open upper surface of the mounting space 96.

The side wall 91 may be formed with a mounting inlet 92 to connect the mounting space 96 and the auxiliary suction passage 61. With this structure, when the robot cleaner 1 operates in the second cleaning mode, the air in the mounting space 96 can be sucked into the auxiliary suction passage 61 through the mounting inlet 92.

Hair, dust, pet hair, or other foreign matter that is attached or buried in the cleaning member 82 after the use of the cleaning tool 80 can be sucked into the auxiliary suction passage 61 through the mounting inlet 92 and guided to the dust collecting apparatus 30.

The tool mounting part 90 may include a scraper 98 to scrape foreign matter that adheres to the cleaning member 82 of the cleaning tool 80 in the process of mounting the cleaning tool 80 to the tool mounting part 90. The foreign matter separated from the cleaning member 82 through the scraper 98 can be more easily sucked into the dust collecting apparatus 30.

The scraper 98 may be provided to protrude from the side wall 91 to the mounting space 96 so as to contact the cleaning member 82 of the cleaning tool 80 in the process of mounting the cleaning tool 80.

The scraper 98 may be provided to be movable such that the scraper 98 and the cleaning member 82 are prevented from being excessively pressed against each other to cause breakage. Also, the cleaning tool 80 is prevented from being caught by the scraper 98 so as not to be mounted on the tool mounting part 90. The scraper 98 may be provided to be movable in an opening 93 formed in the side wall 91.

The scraper 98 is projected farthest normally. The scraper moves in a direction in which the amount of protrusion decreases in the process of mounting the cleaning tool 80 as shown in FIG. 11, and the scraper may be restored to its original position when the cleaning tool 80 is installed as shown in FIG. 12.

To this end, the tool mounting part 90 may include an elastic member 99 to elastically support the scraper 98. One end of the elastic member 99 is supported by the scraper 98 and the other end of the elastic member 99 can be supported by an elastic member support 95 of the tool mounting part 90.

Figure 13:
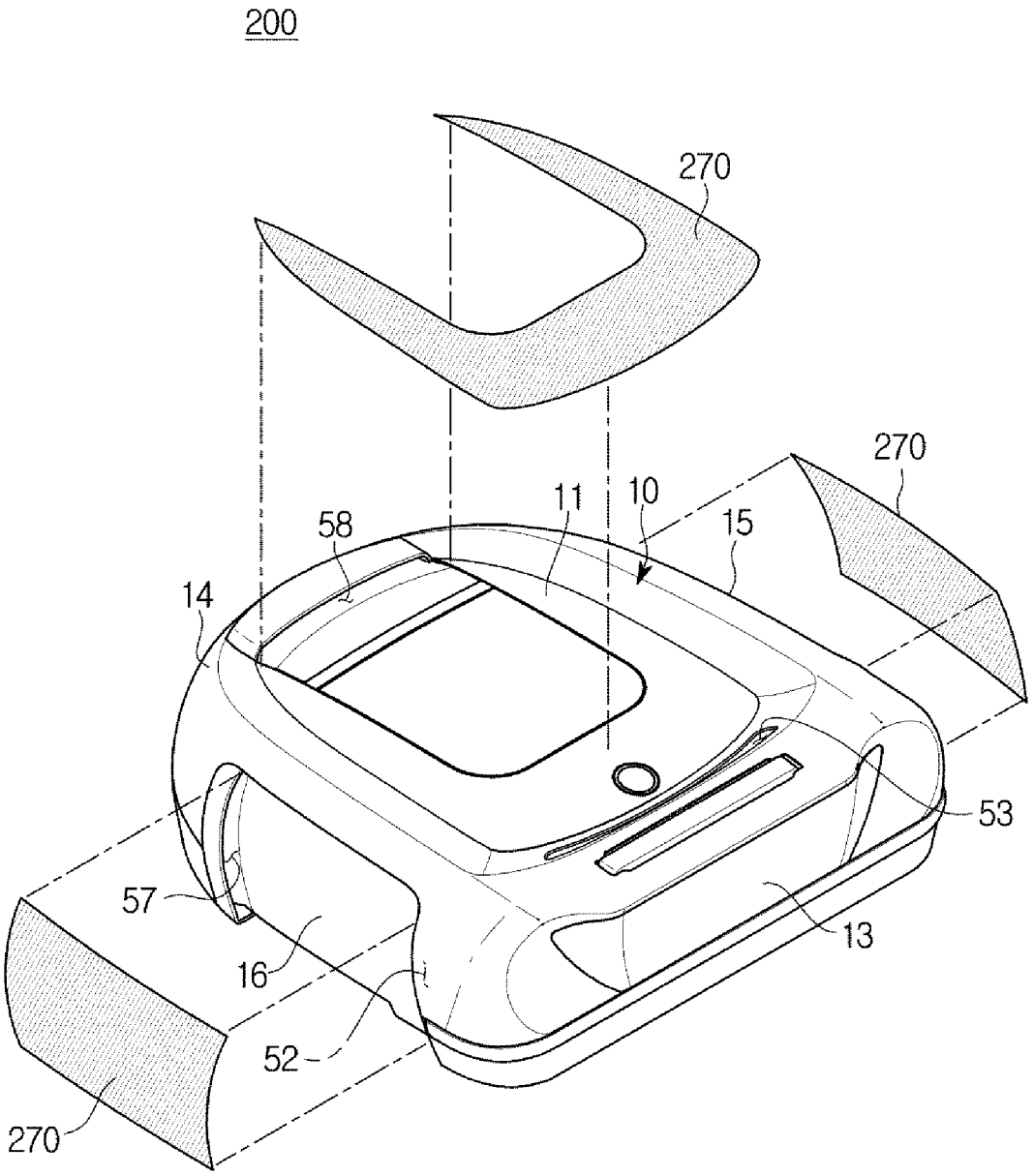
FIG. 13 is a view showing a robot cleaner according to another embodiment of the disclosure according to an embodiment of the disclosure.

FIG. 13 is a view showing a robot cleaner according to an embodiment of the disclosure. A robot cleaner according to another embodiment of the disclosure will be described with reference to FIG. 13. The same reference numerals are assigned to the same components as those of the above-described embodiment, and a description thereof is omitted.

A robot cleaner 200 may include an electrostatic adsorption plate 270 that is configured to adsorb dust or the like from the outside of the main body 10 through static electricity. The electrostatic adsorption plate 270 is charged with a negative potential in consideration of the fact that human hair, pet hair, floating dust, etc. have positive potential in a normal living environment. Therefore, the electrostatic adsorption plates can adsorb them by an electric attraction force.

The electrostatic adsorption plate 270 may be formed of a thin metal plate made of a metal such as aluminum having high conductivity and high electric capacity. The electrostatic adsorption plate 270 may be connected to a static electricity generator (not shown) that receives power from the outside and generates static electricity.

The electrostatic adsorption plate 270 may be attached to the side surfaces 15 and 16 of the main body 10. The electrostatic adsorption plate 270 may be provided between the side suction ports 51 and 52 and the side discharge ports 56 and 57. The foreign matter adsorbed on the electrostatic adsorption plate 270 does not remain attached to the electrostatic adsorption plate 270 but is sucked through the side suction ports 51 and 52 into the main body 10 by the suction wind of the side suction ports 51 and 52 and the exhaust wind of the side discharge ports 56 and 57. Therefore, it is not necessary for the user to remove the dust attached to the electrostatic adsorption plate 270.

The electrostatic adsorption plate 270 may be attached to the top surface 11 of the main body 10. The electrostatic adsorption plate 270 may be provided between the top suction port 53 and the top discharge port 58.

Figure 14:
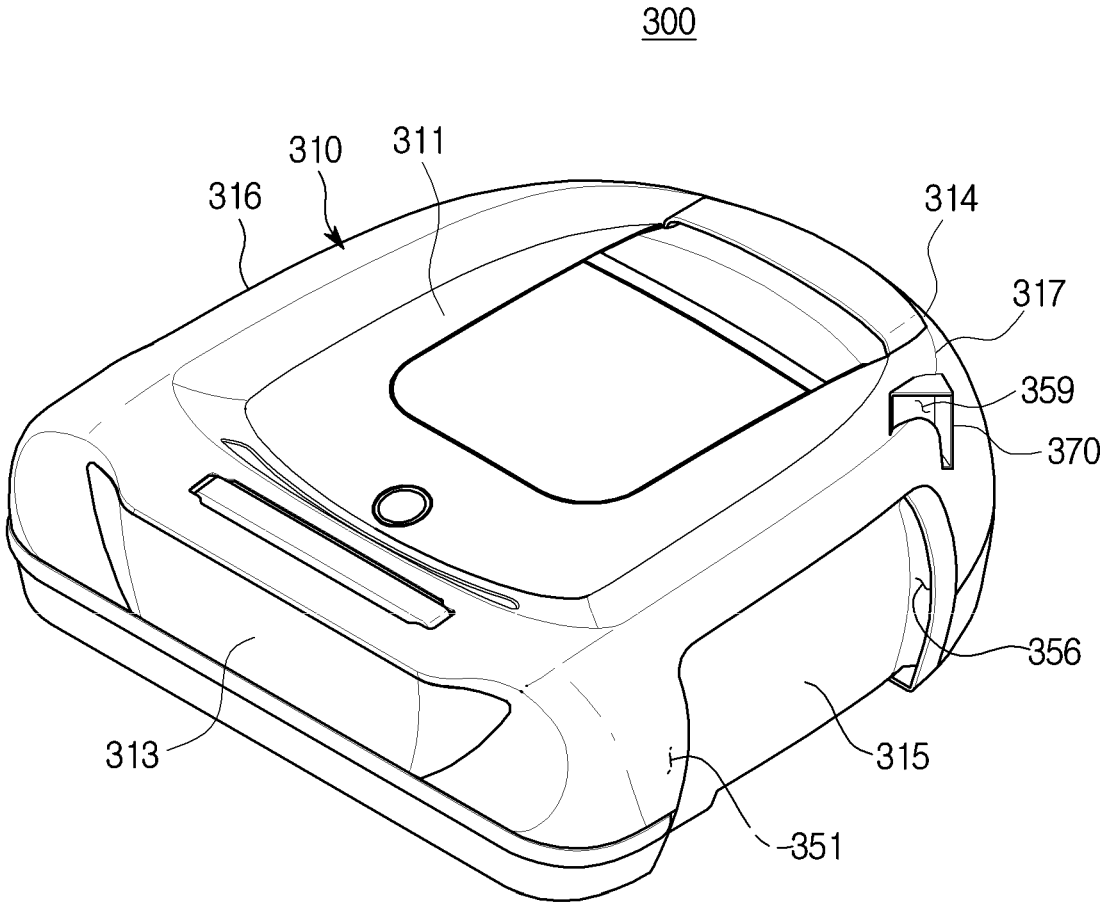
FIG. 14 is a view showing a robot cleaner according to still another embodiment of the disclosure according to an embodiment of the disclosure.
Figure 15:
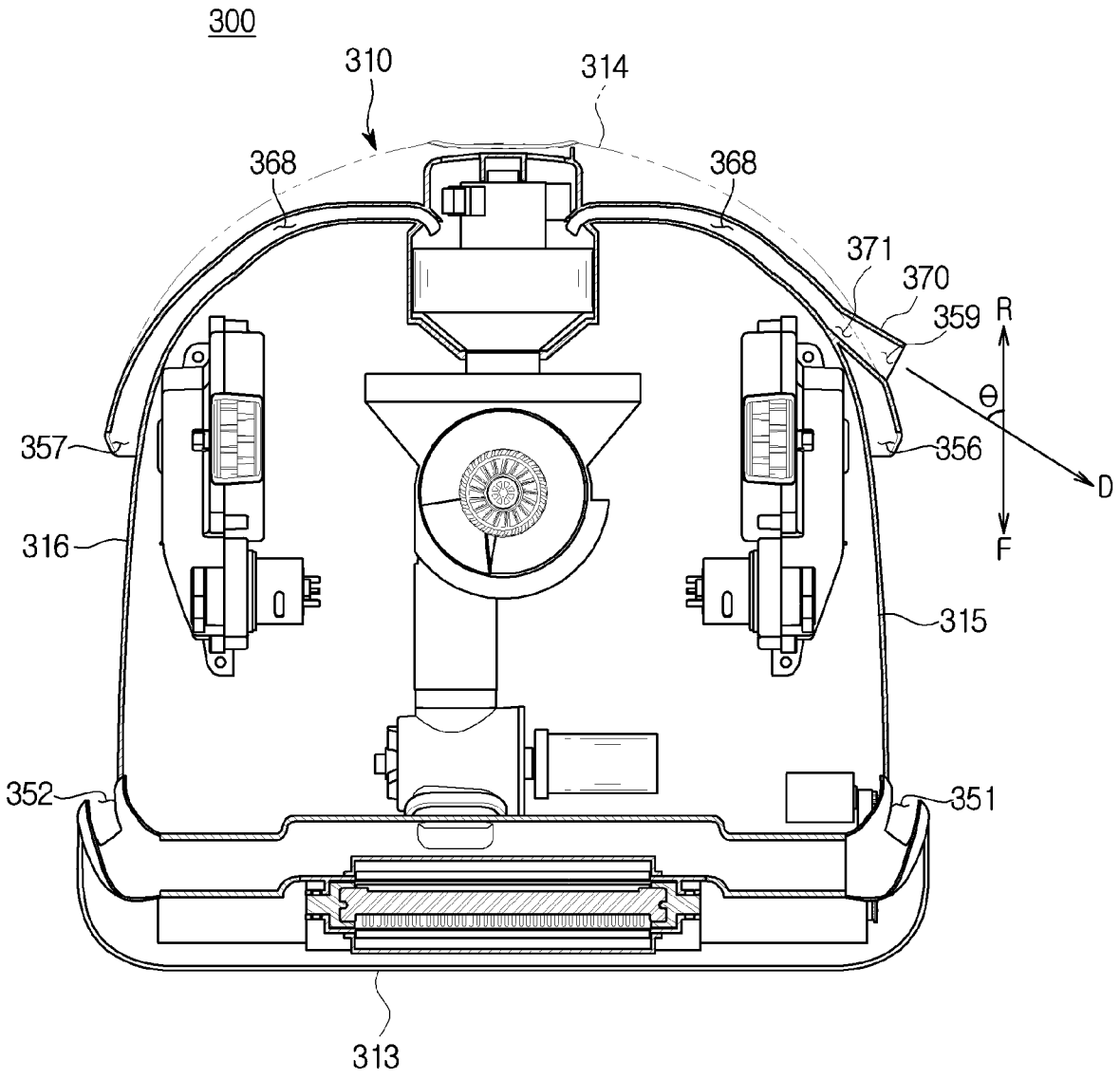
FIG. 15 is a plan view of the robot cleaner of FIG. 14 according to an embodiment of the disclosure.

FIG. 14 is a view showing a robot cleaner according to an embodiment of the disclosure. FIG. 15 is a plan view of the robot cleaner of FIG. 14 according to an embodiment of the disclosure. The same reference numerals are assigned to the same components as those of the above-described embodiment, and a description thereof is omitted.

A robot cleaner 300 may have an auxiliary discharge port 359 in addition to a bottom suction port, side suction ports 351 and 352, a rear discharge port 355 and side discharge ports 356 and 357. The auxiliary discharge port 359 can more effectively scatter the dust on the side and on the top of the robot cleaner 300, thereby increasing the suction efficiency through the side suction ports 351 and 352.

A main body 310 of the robot cleaner 300 has a top surface 311, a bottom surface, a front surface 313, a rear surface 314, a left surface 315 and a right surface 316. The auxiliary discharge port 359 may be provided at the upper end of the left surface 315.

Specifically, the robot cleaner 300 includes a nozzle body 370 protruding laterally and upwardly from a corner 317 connecting the left surface 315 and the top surface 311 of the main body 310. An auxiliary discharge passage 371 branched from the side discharge passage 368 is formed in the nozzle body 370 and the auxiliary discharge port 359 may be formed at the end of the nozzle body 370 to be connected to the auxiliary discharge passage 371.

The auxiliary discharge port 359 is located behind the side suction port 351 and can discharge the wind slantingly with respect to a front and rear direction FR of the robot cleaner 300. That is, a spray direction D of the auxiliary discharge port 359 may be formed to be inclined at a predetermined angle ($\theta$, $0<\theta<90$ degrees) with respect to a front direction F of the robot cleaner 300. Accordingly, the dust on the side and the top of the robot cleaner 300 is effectively scattered by the auxiliary discharge port 359, and the scattered dust can be sucked through the side suction port 351.

In an embodiment, the auxiliary discharge port 359 is provided at the upper end of the left surface 315 of the main body but may be provided at the upper end of the right surface 316 of the main body 310 or both.

As is apparent from the above, the robot cleaner can efficiently clean dust, garbage, pet hair, and the like in the vicinity of side walls or corners of a facility.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A robot cleaner comprising:

a main body;

a fan provided inside the main body and configured to generate a suction force;

a dust collecting apparatus provided to remove dust from air suctioned into the main body;

a side suction port formed on a side surface of the main body to suction dust adjacent a lateral side of the main body into the dust collecting apparatus; and a side discharge port formed on the side surface of the main body to discharge air, cleaned by the dust collecting apparatus, toward the lateral side of the main body, wherein the air discharged by the side discharge port causes dust adjacent to the lateral side of the main body to scatter and be suctioned through the side suction port.

2. The robot cleaner according to claim 1, wherein the side surface of the main body includes a left surface and a right surface, wherein the side suction port is formed on at least one of the left surface or the right surface, and wherein the side discharge port is formed on the side surface on which the side suction port is formed.

3. The robot cleaner according to claim 1, wherein the side suction port and the side discharge port are arranged to face each other.

4. The robot cleaner according to claim 1, further comprising:

a bottom suction port formed on a bottom surface of the main body to suction dust below the main body;

a main suction passage to guide air suctioned through the bottom suction port to the dust collecting apparatus; and an auxiliary suction passage to guide air suctioned through the side suction port to the dust collecting apparatus.

5. The robot cleaner according to claim 4, wherein the main suction passage and the auxiliary suction passage join together in front of the dust collecting apparatus.

6. The robot cleaner according to claim 5, further comprising:

a switching valve provided at a point where the main suction passage and the auxiliary suction passage join together such that the suction force of the fan is transmitted to one of the main suction passage or the auxiliary suction passage.

7. The robot cleaner according to claim 6, wherein the switching valve includes a cylindrical valve housing and a valve body rotatably provided in the cylindrical valve housing.

8. The robot cleaner according to claim 7, wherein the valve body is configured to be rotatable between a first position to open the main suction passage and close the auxiliary suction passage, and a second position to close the main suction passage and open the auxiliary suction passage.

9. The robot cleaner according to claim 8, wherein the valve body includes a valve passage connected to at least one of the main suction passage or the auxiliary suction passage, and wherein the valve passage is connected to the main suction passage when the valve body is in the first position and the valve passage is connected to the auxiliary suction passage when the valve body is in the second position.

10. The robot cleaner according to claim 4, wherein the dust collecting apparatus includes:

an inlet through which the air suctioned through at least one of the main suction passage or the auxiliary suction passage is introduced, a cyclone chamber to centrifugally separate dust by turning the air introduced through the inlet, a dust collecting chamber to collect the dust that has been removed from the cyclone chamber, and an outlet to discharge the dust-removed air from the cyclone chamber.

11. The robot cleaner according to claim 1, further comprising:

an electrostatic adsorption plate provided on the side surface of the main body to adsorb dust from the outside of the main body through static electricity.

12. The robot cleaner according to claim 11, wherein the electrostatic adsorption plate is disposed between the side suction port and the side discharge port.

13. A robot cleaner comprising:

a main body;

a fan provided inside the main body and configured to generate a suction force;

a dust collecting apparatus provided to remove dust from air suctioned into the main body; and an electrostatic adsorption plate provided on at least one of a top surface or a side surface of the main body to adsorb dust outside the main body through static electricity.

14. The robot cleaner according to claim 13, wherein the electrostatic adsorption plate is provided on the side surface of the main body, and wherein the robot cleaner further comprises a side suction port formed on the side surface of the main body to suction dust adhering to the electrostatic adsorption plate.

15. The robot cleaner according to claim 13, wherein the electrostatic adsorption plate is provided on the top surface of the main body, and wherein the robot cleaner further comprises a top suction port formed on the top surface of the main body to suction dust adhering to the electrostatic adsorption plate.

16. A robot cleaner comprising:

a main body;

a fan provided inside the main body and configured to generate a suction force;

a dust collecting apparatus provided to remove dust from air suctioned into the main body;

a suction port formed on a bottom surface of the main body to suction dust below the main body;

a main suction passage to guide air suctioned through the suction port to the dust collecting apparatus;

a cleaning tool for handheld and manual cleaning;

a tool mounting part provided on the main body to detachably mount the cleaning tool; and an auxiliary suction passage to suction dust from the tool mounting part by removing dust attached to the tool mounting part and guide the dust to the dust collecting apparatus.

17. The robot cleaner according to claim 16, wherein the tool mounting part includes a scraper configured to scrape dust adhering to the cleaning tool in a process of mounting the cleaning tool on the tool mounting part.

18. The robot cleaner according to claim 17, wherein the scraper is configured to move in the process of mounting the cleaning tool, and wherein the tool mounting part includes an elastic member to elastically support the scraper.

19. The robot cleaner according to claim 16, wherein the main suction passage and the auxiliary suction passage join together in front of the dust collecting apparatus.

20. The robot cleaner according to claim 19, further comprising:

a switching valve provided at a position where the main suction passage and the auxiliary suction passage join together such that the suction force of the fan is transmitted to one of the main suction passage or the auxiliary suction passage.

* * * * *